US007256694B2

(12) United States Patent
Papari et al.

(10) Patent No.: US 7,256,694 B2
(45) Date of Patent: Aug. 14, 2007

(54) AUTOMATIC LID OPENING AND CLOSING SYSTEM FOR A WASTE CONTAINER

(75) Inventors: Joanne Papari, Mississauga (CA); Chris Rusu, Richmond Hill (CA); Leonardo Stefan, Toronto (CA)

(73) Assignee: Biochem Environmental Solutions Inc., Concord, Ontario (CA)

( * ) Notice: Subject to any disclaimer, the term of this patent is extended or adjusted under 35 U.S.C. 154(b) by 416 days.

(21) Appl. No.: 10/427,122

(22) Filed: May 1, 2003

(65) Prior Publication Data

US 2003/0205979 A1 Nov. 6, 2003

(51) Int. Cl.
*G08B 13/00* (2006.01)

(52) U.S. Cl. ..... 340/565; 340/566; 340/567; 340/539.21; 340/539.23; 340/825.69; 318/466; 318/480

(58) Field of Classification Search ..... 340/565, 340/566, 567, 568.1, 539.19, 539.21, 539.23, 340/825.69, 825.72; 318/16, 280, 286, 466, 318/480

See application file for complete search history.

(56) References Cited

U.S. PATENT DOCUMENTS 4,609,122 A 9/1986 Ziegenbein ..... 220/211
4,996,467 A 2/1991 Day ..... 318/480
5,329,212 A 7/1994 Feigleson ..... 318/16
5,770,935 A 6/1998 Smith et al. ..... 318/480
5,932,982 A 8/1999 Pezzelli, Jr. ..... 318/480
6,150,939 A 11/2000 Lin ..... 340/568.1
6,752,476 B2 * 6/2004 Lin ..... 312/290
6,859,005 B2 * 2/2005 Boliver ..... 318/480

* cited by examiner

*Primary Examiner*—Hung Nguyen
(74) *Attorney, Agent, or Firm*—Jeffrey S. Sokol; Cook & Franke S.C.

(57) ABSTRACT

A lid opening and closing system for a waste container having an opening and a lid for covering the opening, the system including a proximity sensor, which may be a capacitive proximity sensor, for sensing the presence of a user's hand or body near the waste container and for sending a control signal. A drive system is connected to the lid for causing the lid to move from a closed position, where the lid covers the opening, to an open position, where the waste container is positioned to accept waste, and then back to the closed position in response to the control signal. The proximity sensor being more sensitive to the user's hand or body approaching from the top of the waste container rather than from the front, sides or back of the waste container.

12 Claims, 6 Drawing Sheets

AUTOMATIC LID OPENING AND CLOSING SYSTEM FOR A WASTE CONTAINER

FIELD OF THE INVENTION

The present invention relates generally to an automatic door opening and closing system, and more particularly, to an automatic system for waste containers that automatically opens the waste container lid when a user approaches to deposit waste and automatically closes the lid once the waste has been deposited.

BACKGROUND OF THE INVENTION

Waste receptacles are provided in various public and private locations for the purpose of providing a convenient place to deposit waste for collection and temporary storage. Such containers must have an opening through which the waste can be deposited. This opening is often equipped with a lid to keep the waste enclosed within the container and to prevent unpleasant odors, generally associated with waste, from escaping. The lid also limits viewing of the unsightly contents of the waste container. One of the main difficulties with such lids is that users must physically contact the lid to gain access to the container and deposit the waste. Often a user's hands are full with the waste to be deposited, or other items, leaving no easy means by which to open and close the lid. In other situations, the lid itself becomes contaminated with waste and the user does not wish to touch the lid in order to open it.

These deficiencies have been addressed by developing automatically operating lids for waste containers. For example, U.S. Pat. No. 5,329,212, issued to Feigleson, and U.S. Pat. No. 5,770,935, issued to Smith and Wells, describe waste containers having a vertical opening in a sidewall and a door hinged from a top edge of the opening. An infrared detector is mounted near the opening to sense the presence of a person within a predetermined proximity in front of the container. A motor is mounted inside the container and connected to the door by a cable or an arm and cable assembly. When a user approaches the container, the infrared detector activates the motor, which opens the door. When the user departs, the motor reverses and the door is closed. One problem with this system is that depositing waste through an opening in a vertical sidewall is more difficult than through an opening in the top of the container. In the former case, a user must reach well into the container to properly deposit the waste, thus possibly exposing the user's hand and arm to waste material. If the user does not reach far enough into the container, waste can be spilled down the outside wall. The above-noted systems, as disclosed, are not easily adaptable to a lid mounted within a horizontal opening. Moreover, the infrared detectors are designed to sense the presence of a user in front of the container. Thus, a person merely passing in front of the container, or standing next to the container, but not wishing to deposit waste, may inadvertently trigger the sensor and cause the lid to open, unnecessarily releasing odor and contaminants from the waste container.

This latter problem is addressed by U.S. Pat. No. 5,932,982 to Pezzelli. In the system described by Pezzelli, the sensor is mounted on the inner periphery of a recessed bay in a vertical sidewall of the container or the container's lid, thus limiting the inadvertent detection of objects beyond this inner periphery. One problem with the system described by Pezzelli, is that a user must move his hand, or portions of the waste material, within range of the sensor before the door will open. Because of the location of the sensor within the recessed bay, this often results in physical contact between the user's hand or the waste material and the door before the door opens. The door is likely to become contaminated if waste material comes in contact with the door. Moreover, the system described by Pezzelli, has not addressed the above-described problems associated with waste containers having vertical openings in their sidewalls.

U.S. Pat. No. 4,609,122 to Ziegenbein, describes an automatic touch-actuated door opener for a waste container. Again, this system is designed for operation on a door suspended in a vertical opening in the container sidewall, and requires physical contact between the user and the door to actuate opening. The requirement for physical contact between the user and the door can result in contamination of the door due to spillage of waste.

U.S. Pat. No. 6,150,939 to Lin, describes a waste container having a door located in a horizontal opening in an upper side thereof. The door is opened when an electric eye mounted on a control panel located toward the back of the device senses a user within a predetermined space. U.S. Pat. No. 4,996,467 to Day, describes a waste container having a lid located in the top of the container that will open automatically in response to infrared sensors mounted on the front of the container to sense the presence of a person. One problem with these systems is that a person merely passing in front of the container, or standing next to the container, but not wishing to deposit waste, may inadvertently trigger the sensor and cause the lid to open, unnecessarily releasing odor and contaminants from the waste container.

What is needed then, is an automatic lid opening and closing system for a waste container that remedies the deficiencies inherent in the prior art.

SUMMARY OF THE INVENTION

In view of the foregoing, an object of one aspect of the present invention is to provide an improved automatic lid opening and closing system for a waste container.

It is an object of another aspect of the present invention to provide an automatic lid opening and closing system for a waste container having a unidirectional sensor for activating the lid opening system that is more sensitive to stimulus coming from the top rather than from the sides, front or back of the container.

It is an object of another aspect of the present invention to provide an automatic lid opening and closing system for a waste container having a sensor for activating the lid opening system that generates a low amount of electro magnetic interference.

It is an object of another aspect of the present invention to provide an automatic lid opening and closing system for a waste container having the drive system for opening and closing the lid located outside of the waste container enclosure.

It is an object of yet another aspect of the present invention to provide an automatic lid opening and closing system for a waste container having a drive system for opening and closing the lid that is sufficiently flexible and sufficiently durable to absorb abuse due to poor synchronization and manual operation of the lid.

It is an object of a further aspect of the present invention to provide an automatic lid opening and closing system for a waste container that will permit the lid to be opened and closed manually, if necessary.

It is an object of a still further aspect of the present invention to provide an automatic lid opening and closing system for a waste container that uses a DC motor combined with a reduction system that uses belt driven wheels and a geared transmission to open and close the lid.

According to one aspect of the present invention there is provided, a lid opening and closing system for a waste container, the waste container having an opening and a lid for covering the opening, comprising: a proximity sensor for sensing the presence of a user's hand or body near the container and for sending a control signal when the user's hand or body approaches to within a predetermined distance of the container, the proximity sensor being more sensitive to the user's hand or body approaching in a vertically downward direction towards a top of the container than horizontally from a front, sides or a back of the container; and a drive system connected to the lid for causing the lid to move from a closed position, wherein the lid covers the opening, to an open position, wherein the waste container is positioned to accept waste, and then back to the closed position in response to the control signal.

According to another aspect of the present invention there is provided a lid opening and closing system for a waste container, the waste container having an opening and a lid for covering the opening, comprising: a capacitive proximity sensor for sensing the presence of a user's hand or body near the waste container and for sending a control signal when the user's hand or body approaches to within a predetermined distance of the container, the sensor being more sensitive to the user's hand or body approaching in a vertically downward direction towards a top of the container than horizontally from a front, sides or a back of the container; and a drive system connected to the lid for causing the lid to move from a closed position, wherein the lid covers the opening, to an open position, wherein the waste container is positioned to accept waste, and then back to the closed position in response to the control signal.

In a further aspect, the waste container is an open topped receptacle with a top cover for covering the open top, and the opening is a substantially horizontal opening in the top cover. In another aspect, the proximity sensor includes at least one sensing plate oriented horizontally.

In yet another aspect, the waste container is an open topped receptacle defining an interior space with a top cover for covering the open top, and the drive system is located outside the interior space.

In a still further aspect, the drive system includes a motor having an output shaft and a drive reduction system connected between the output shaft and the lid, such that rotation of the output shaft in one direction causes the lid to move from the closed position toward the open position, and rotation of the output shaft in the opposite direction causes the lid to move from the open position toward the closed position.

In another aspect, the drive reduction system includes a plurality of wheels, at least one being fixed to the output shaft, at least one drive gear fixed to one of the wheels, and a driven gear connected to the lid and rotatably engaged with at least one drive gear.

In other aspects, the drive belt can be made of a flexible material, or the power supply may be portable and preferably attached to the container. In order to account for variability of installations, the sensitivity of the sensor may be variable.

In yet another aspect, the lid is pivotally mounted to the waste container and is caused by the drive system to pivot alternatively between the closed and the open positions. The lid may also comprise top and bottom panels defining a wedge-shaped scoop, with the lid being attached to the waste container so that it is pivotable within the opening between the open position wherein the bottom panel covers the opening and the scoop is positioned to receive waste material, and the closed position wherein the top panel covers the opening and the scoop is positioned to deposit waste material into the waste container.

Advantageously, the automatic lid opening and closing system of the present invention is more sensitive to stimulus coming from the top rather than from the sides, front and back of the container and thus will not cause the lid to inadvertently open when a person merely passes in front of the waste container or stands next to the container but does not wish to deposit waste. Other advantages of the automatic lid opening and closing system of the present invention include: 1) the capacitive proximity sensor generates a low amount of electromagnetic interference and therefore does not interfere with other sensitive equipment; 2) the drive system is covered and located on the outside of the waste receptacle, thus avoiding contamination by waste material; 3) the lid can be opened manually in the event of failure of the sensor; 4) the drive system is sufficiently durable and flexible enough to handle the physical abuse it is likely to encounter; 5) the drive system is sufficiently quite so that it can be used in waste containers installed in private locations where a noisy system might be a deterrent; 6) the entire system is less expensive to manufacture than other comparable lid opening and closing systems; 7) the entire system requires less energy to operate than comparable lid opening and closing systems and is thus ideal for use with batteries; 8) for a similar cost, the active sensing area of the capacitive proximity sensor system is wider than that of an opto-electric sensor; and 9) the capacitive proximity sensor system will respond only to stimulus from large conductive objects placed in the sensing field; smaller objects inadvertently passing through the sensing field will not inadvertently trigger lid opening as can happen with an opto-electric sensor.

BRIEF DESCRIPTION OF THE DRAWINGS

The present invention will be further understood from the following description of a preferred embodiment with reference to the drawings in which.

Similar reference numerals are used in different figures to denote similar components.

DETAILED DESCRIPTION OF THE PREFERRED EMBODIMENT

Figure 1:
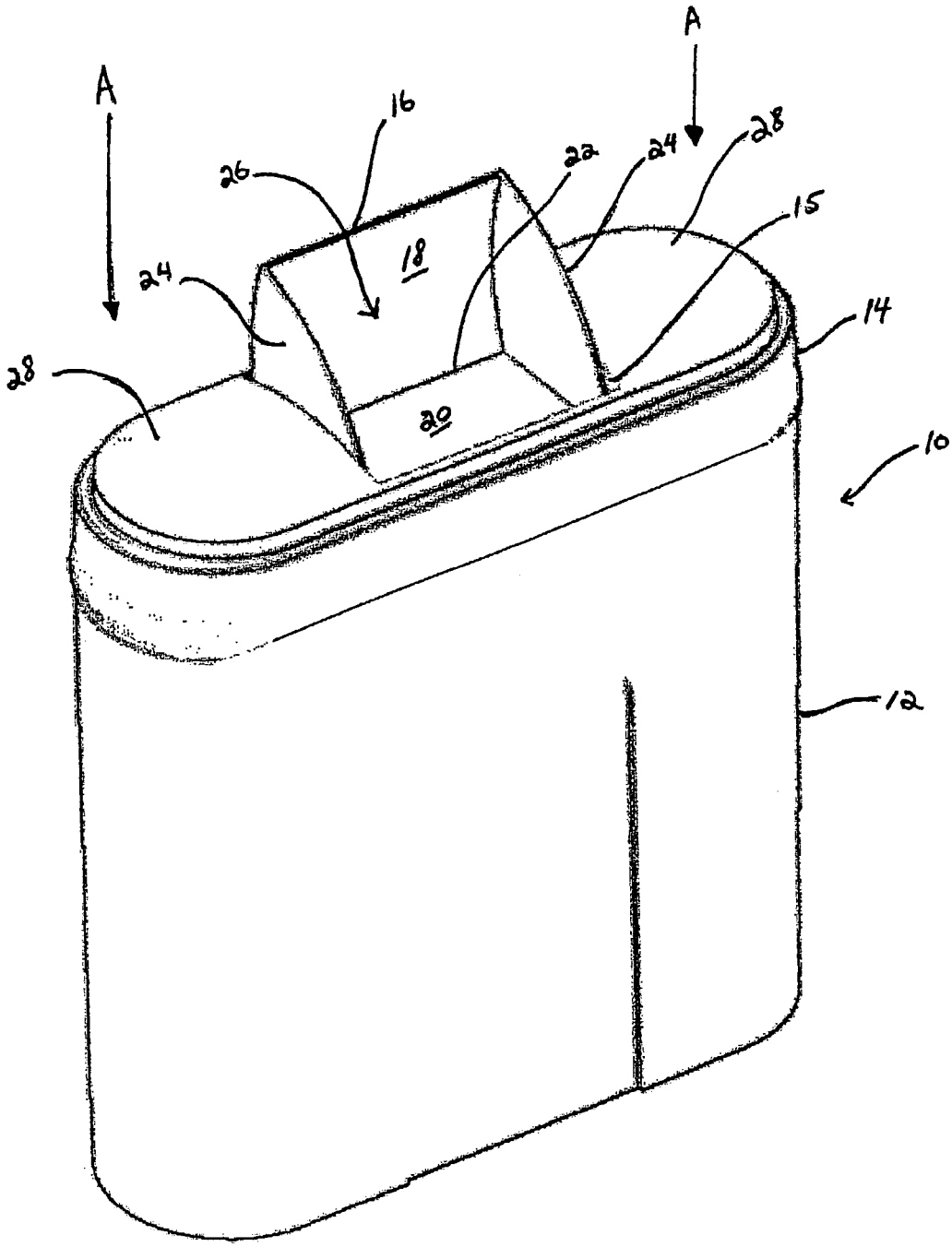
FIG. 1 is a front perspective view of one possible configuration of a waste container for use with the present invention, showing the lid in an open position.
Figure 6:
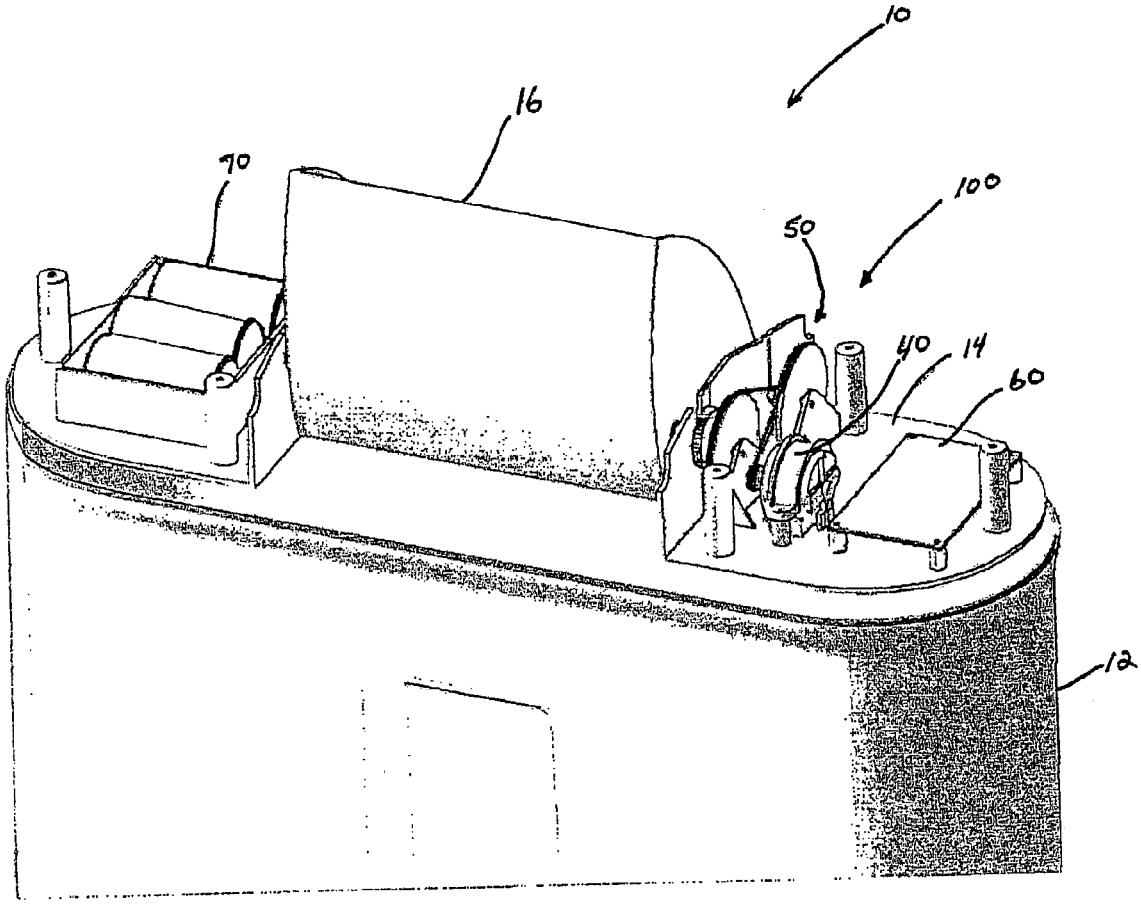
FIG. 6 is a rear, low-angle, perspective view of the waste container shown in FIG. 1, with the cover plate removed.

FIG. 1, shows a waste container 10 having an open-topped waste receptacle 12 and a top cover 14 that fits over the top of receptacle 12 and can be removed for emptying and cleaning of receptacle 12. Top cover 14 includes a horizontal opening 15 into which is pivotably mounted a lid 16. In the preferred embodiment shown in FIG. 1, lid 16 is formed in the shape of a wedge-shaped scoop, comprised of a generally rectangular top panel 18 and a generally rectangular back panel 20 joined along a common edge 22 and further joined by opposing side panels 24 to form a wedge-shaped scoop or receptacle having a front opening 26. Lid 16 is pivotably mounted to top cover 14 on pins 27 (see FIGS. 2 and 6) located near common edge 22, on either side of lid 16 so that lid 16 can rotate freely within opening 15 between a closed position where top panel 18 covers opening 15 and waste container 10 is closed, and an open position (as shown in FIG. 1) where bottom panel 20 covers opening 15 and lid 16 is positioned to accept waste for deposit into waste container 10. A removable cover plate 28 covers the top portion of top cover 14.

Figure 2:
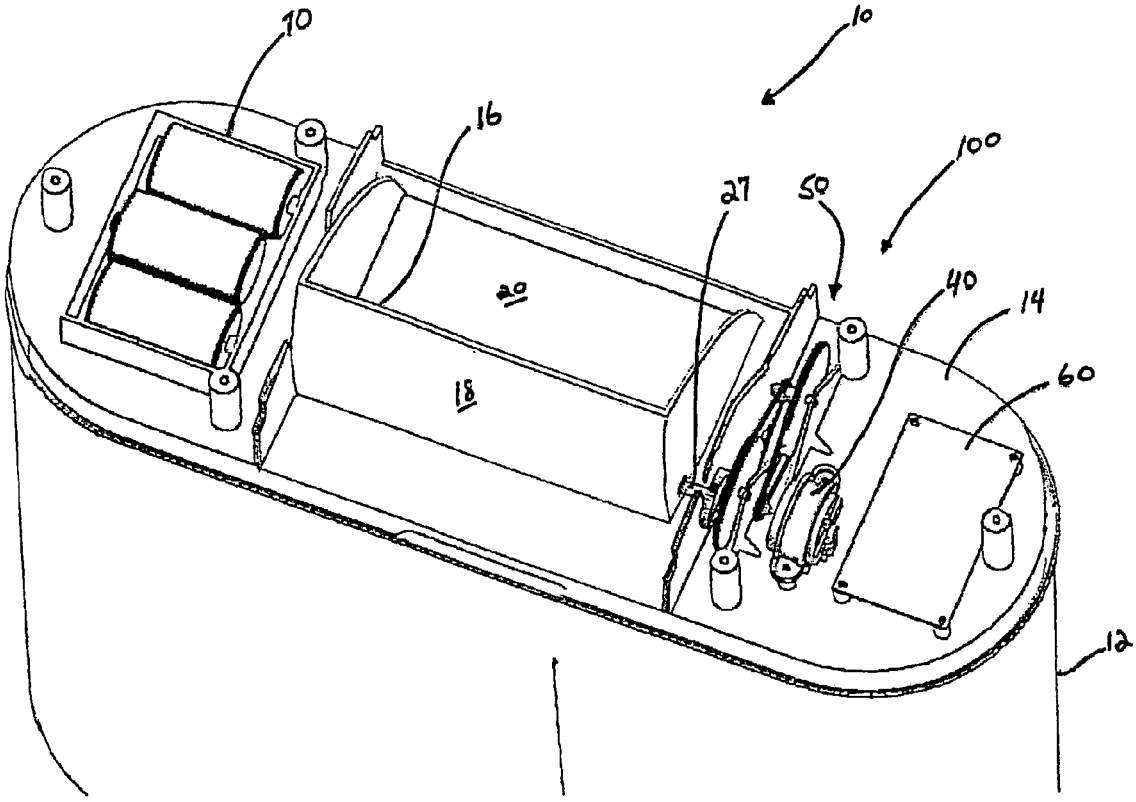
FIG. 2 is rear, high-angle, perspective view the waste container shown in FIG. 1, with the cover plate removed.
Figure 5:
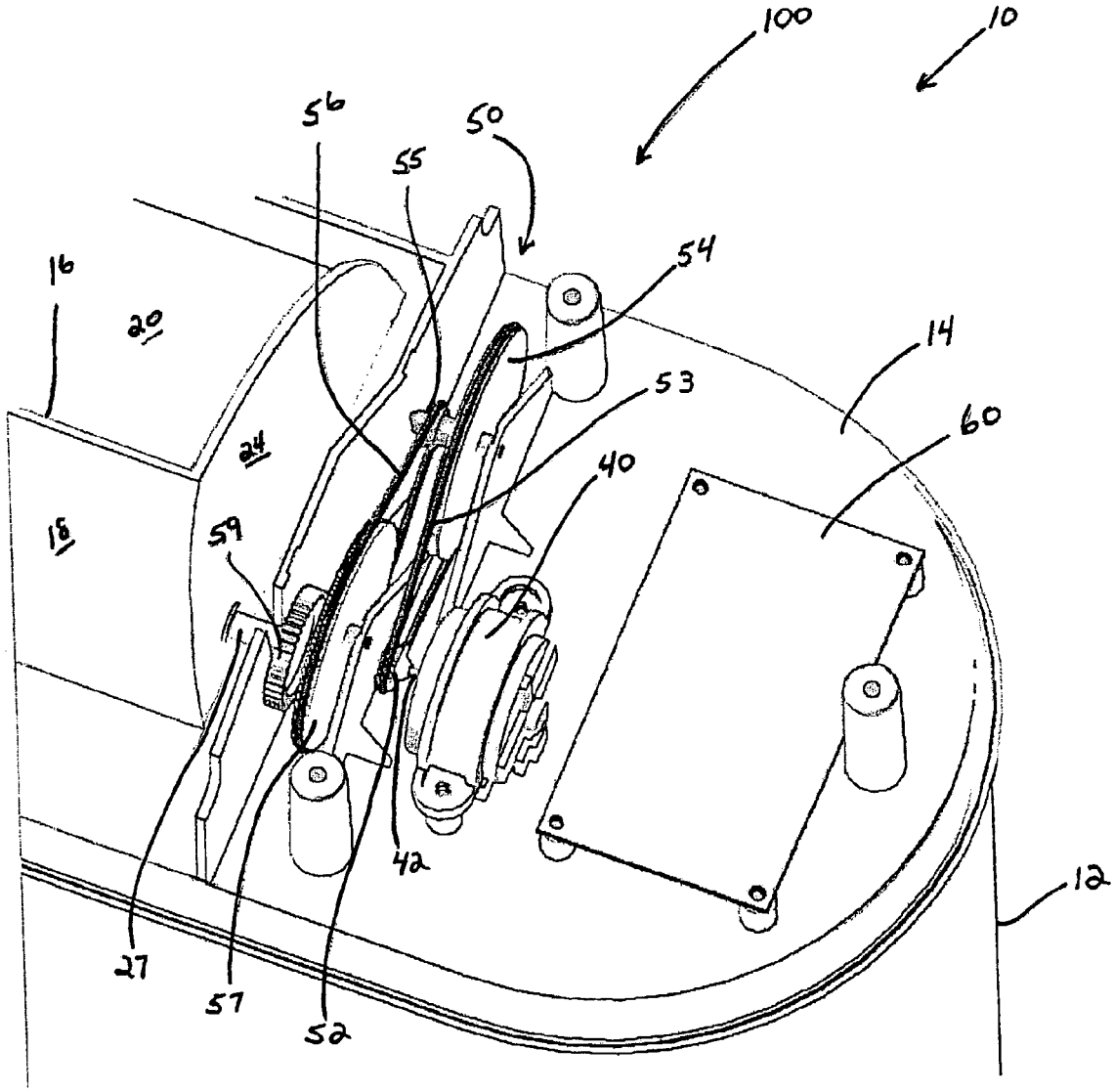
FIG. 5 is an enlarged, rear, high-angle perspective view of the right side of the waste container shown in FIG. 2.

FIG. 2 is a rear, high-angle perspective view of container 10 with cover plate 28 removed to show a circuit board 60, a portable power supply (battery) 70, and a drive system 100, comprising a drive motor 40 and a drive reduction system 50, all mounted to the top surface of top cover 14 on the exterior of receptacle 12. FIG. 5 in an enlarged, high-angle perspective view showing more detail of drive system 100.

Figure 3:
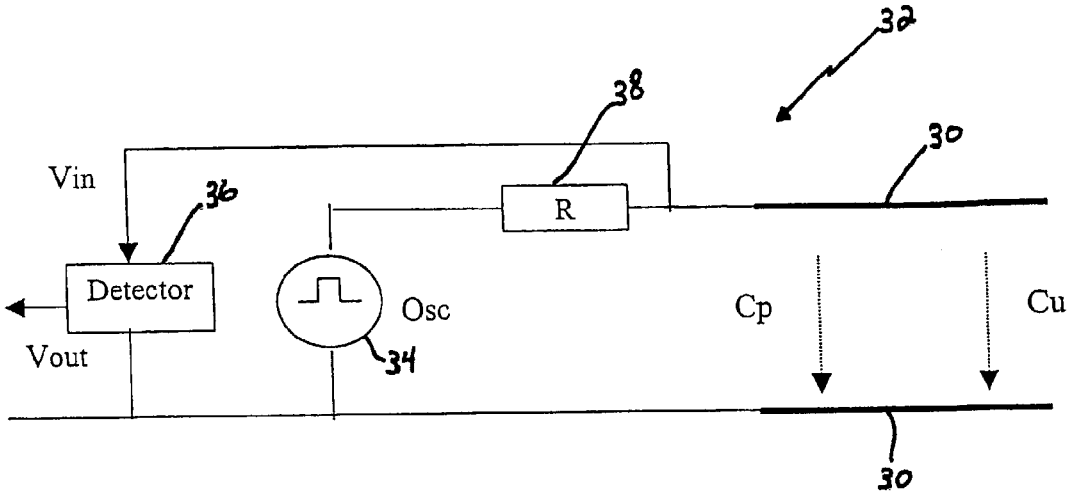
FIG. 3 is schematic view of the capacitive proximity sensor of the present invention.
Figure 4:
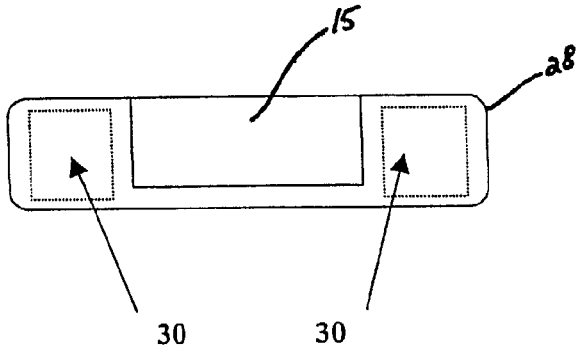
FIG. 4 is a top-down, plan view of the cover plate of the waste container shown in FIG. 1, showing the location of the capacitive proximity sensor plates on the underside of the cover plate.

Referring to FIG. 3, a proximity sensor 32 includes an oscillator 34, a detector 36, a resistor 38, sensing plates 30 (also see FIG. 4), and power supply 70 (see FIG. 2). Also included, but not shown in FIG. 3, are timing and motor drive circuits, as well as electrical noise filtering circuits. The components of proximity sensor 32, exclusive of sensing plates 30 and power supply 70, are designed to fit on circuit board 60, which has connections for sensing plates 30 and power supply 70, and outputs for controlling drive motor 40. As shown in FIG. 4, sensing plates 30 are oriented horizontally and affixed to the underside of cover plate 28, and are preferably made from a thin metal foil, such as aluminum.

Preferably, proximity sensor 32 is a capacitive proximity sensor. Oscillator 34 feeds a constant low frequency signal to horizontal sensing plates 30, causing them to generate a unidirectional electric field that is more sensitive to stimulus coming vertically downward towards the top of container 10, in the direction of arrows A (see FIG. 1), rather than horizontally from the sides, front or back of container 10. Proximity sensor 32 is therefore less likely to be activated by a person simply passing in front of container 10, or standing next to the container, but not wishing to deposit waste.

Sensor 32 detects the presence of a user's hand or body within the generated electric field by measuring the variance in capacitance as the user's hand or body approaches sensing plates 30. In stand-by mode, lid 16 is closed and an input signal Vin sent to detector 36 has a constant level. When a user wishing to deposit waste interfaces with the electric field, input signal Vin at detector 36 changes. Input signal Vin is amplified and filtered by the electrical noise filtering circuits to remove ambient electrical noise. If Vin at detector 36 is above a certain selected threshold, a control signal Vout is sent to the timing and motor drive circuits (not shown), which activate drive system 100. Drive system 100 is activated to rotate lid 16 in three phases: 1) an opening phase, where lid 16 is moved from a closed position in which top panel 18 covers opening 15 to an open position where bottom panel 20 covers opening 15 and lid 16 is positioned to accept waste; 2) a hold phase, where the open position is maintained for a selected period of time sufficient to permit the user to place waste material on back panel 20 within the scoop-shaped opening 26 of lid 16; and 3) a closing phase, where the drive direction of motor 40 is reversed causing lid 16 to rotate on pins 27 and return to the closed position, thus depositing the waste material into receptacle 12. After the closing phase is complete, drive system 100 is deenergized and the system returns to the stand-by mode.

Referring to FIG. 5, drive system 100 includes an output shaft 42 on motor 40 connected to drive reduction system 50, which is in turn connected to one of pins 27 located on the side of lid 16 nearest motor 40. The purpose of drive reduction system 50 is to transmit power from output shaft 42, which rotates at relatively high revolutions per minute (rpm), to turn pin 27 at a relatively low rate of two to three rpms, resulting in an opening and closing rate for lid 16 of approximately 2 seconds. Drive reduction system 50 includes a ¼" grooved drive wheel 52 on the end of shaft 42. A first drive belt 53 connects drive wheel 52 to a 2" first grooved driven wheel 54. A ¼" second grooved driven wheel 55 is located on the shaft of first grooved driven wheel 54 and is connected by a second drive belt 56, to a 2" third grooved driven wheel 57. A ¼" toothed drive gear (not shown) is connected on the shaft of third grooved driven wheel 57 and rotates on contact with the teeth of a 1" driven gear 59 fixed to the one of pins 27 located on the side of lid 16 nearest motor 40. Rotation of the drive gear in one direction will cause lid 16 to move from its closed position toward its open position, while rotation of the drive gear in the opposite direction will cause lid 16 to move from its open position back towards its closed position. During the hold phase, the friction inherent in drive system 100 prevents lid 16 from rotating closed on it own, thus keeping lid 16 in the open position until the drive gear is reversed to close lid 16.

Drive belts 53 and 56 are preferably made from a flexible material such as rubber, which reduces noise in drive system 100 and increases the ability of drive system 100 to handle abuse due to, for example, poor synchronization between motor cutoff and lid travel, or attempts by users to manually operate lid 16. Should motor 40 malfunction, flexible drive belts 53 and 56 will flex and slip sufficiently to permit full manual operation of lid 16 without damage to motor 40 or drive reduction system 50. The geared connection between pin 27 and drive reduction system 50 ensures good torque transmission at a point where the danger of belt slippage over a ¼" drive wheel would be considerable.

It will be understood by those skilled in the art that the above-described drive reduction system 50 is an example of one type of system that can be used in the present invention. Depending on the power and speed of motor 40, the desired power output, and the desired speed of opening and closing, it may be necessary to adjust the size or number of the drive and driven wheels and gears used.

Drive motor 40 is preferably a 4.5 volt DC motor developing power of approximately 500 mW, at a rate speed of 2400+/−10% rpm. Other suitable drive motors could be used.

The sensitivity of proximity sensor 32 is given by the variance in capacitance of the system C(d), which is increased when a user's hand or body approaches sensing plates 30 in accordance with the following equation:

$$C(d)=Cp+Cu(d)$$

where Cp is the parasitic capacitance of waste container 10 alone, and Cu(d) is the capacitance induced by the presence of a person approaching the container at a distance d to deposit waste. Cu(d) varies according to the following formula:

$$Cu(d)=k*S/d$$

where k is a constant, S is the equivalent common parallel surface area of sensing plates 30 and the user's hand or body, and d is the distance between the user's hand or body and sensing plate 30. As the distance d decreases, the capacitance of the system C(d) increases.

The input signal Vin to detector 36 at a time "t" is described by the formula:

$$\mathrm{Vin}(t)=\mathrm{Vbat}*\mathrm{Exp}(-t/(R*C(d)))\ 0<t<T$$

where Vbat is the voltage of battery 70, T is the period of oscillator 34, and R is the resistance of resistor 38. Increasing the capacitance C(d) of the system increases Vin to detector 36.

The output signal Vout from detector 36 is described by the formula:

$$\mathrm{Vout}=\int \mathrm{Vin}(t)dt=Vo=F(d)$$

Vout has a constant component Vo, which is dependent on the fixed parameters of the system (shape of container 10, material, size of sensing plates 30, etc.), and a variable component F(d), which is dependent only on the distance d between a user's hand or body and sensing plates 30.

The sensitivity of proximity sensor 32 is given by the change in capacitance of the sensing system dC when a user's hand or body moves from a farther distance D to a closer distance d. The change in capacitance is given by the formula:

$$dC=C-Co$$

where C is the capacitance of sensor 32 when the user's hand or body is at closer distance d and Co is the capacitance when the user's hand or body is at farther distance D. C and Co are described by the following formulas, respectively:

$$C=k*S/d$$

$$Co=k*S/D$$

These formulas depend inversely on the distance D or d between the user's hand or body and sensing plates 30, and directly on the equivalent common parallel surface area S of sensing plates 30 and the user's hand or body. Since sensing plates 30 are oriented horizontally, under cover plate 28, the equivalent common parallel surface area S for a user's hand or body approaching from the top, is greater than for a user's hand or body approaching from the sides, front or back. This is illustrated graphically in FIGS. 7*a* and 7*b*.

Figure 7A:
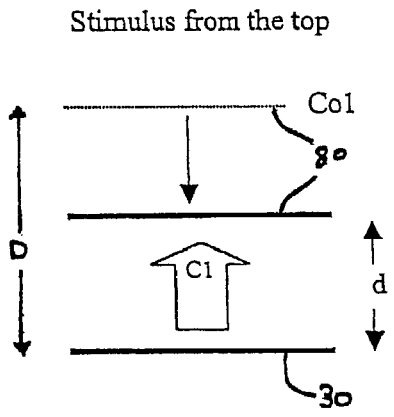
FIG. 7*a* is a schematic diagram illustrating the sensitivity of the sensor of the present invention in response to stimulus from the top.

FIG. 7*a*, shows a stimulus 80, such as a user's hand, having a planar surface, and approaching from the top of sensor plate 30 from a distance D to a distance d. The change in capacitance dC1 of the sensor 32 is measured by the formula:

$$dC1=C1-Co1$$

where C1 is the capacitance at distance d and Co1 is the capacitance at distance D.

Figure 7B:
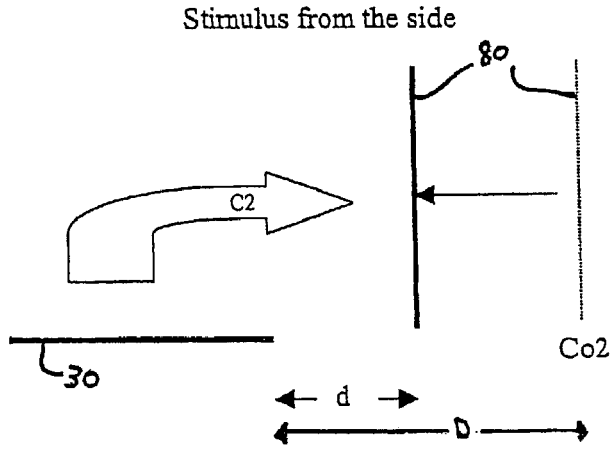
FIG. 7*b* is a schematic diagram illustrating the sensitivity of the sensor of the present invention in response to stimulus from the side.

FIG. 7*b*, shows a stimulus 80, such as a user's hand, having a planar surface, and approaching from the side of sensor plate 30 from a distance D to a distance d. The change in capacitance dC2 of the sensor 32 is measured by the formula:

$$dC2=C2-Co2$$

where C2 is the capacitance at distance d and Co2 is the capacitance at distance D.

Since the equivalent common surface area of the capacitor formed by sensing plate 30 and stimulus 80 in situation shown in FIG. 7*a* is greater than in FIG. 7*b*, dC1 is greater than dC2. As a result, the sensitivity of proximity sensor 32 is greater for stimulus coming from the top of container 10, rather than from the sides, front or back. The result is that lid 16 is less likely to be caused to inadvertently open by a person merely passing in front of container 10, or standing next to container 10, but not wishing to deposit waste.

The present invention has been conveniently described with respect to a waste container having a scoop-shaped lid, pivotally mounted within a horizontal opening in the top portion of the container. It will be appreciated by those skilled in the art that the drive system and proximity sensor described herein could readily be adapted to waste containers having different shaped lids and openings. For example, a planar lid, pivotally mounted within the opening may be used. Alternatively, a planar lid could be slidably mounted within the opening for operation by the drive system.

The invention may be embodied in other specific forms without departing from the spirit or essential characteristics thereof. The present embodiments are therefore to be considered as illustrative and not restrictive, the scope of the invention being indicated by the appended claims rather than by the foregoing description, and all changes that come within the meaning and range of equivalency of the claims are therefore intended to be embraced therein.

The embodiments of the invention in which an exclusive property or privilege is claimed are defined as follows:

1. A lid opening and closing system for a waste container, the waste container having an opening and a lid for covering the opening, comprising:

a capacitive proximity sensor for sensing the presence of a user's hand or body near the container and for sending a control signal when said user's hand or body approaches to within a predetermined distance of the container, said proximity sensor being more sensitive to said user's hand or body approaching in a vertically downward direction towards a top of the container than horizontally from a front, sides or a back of the container; and a drive system connected to the lid for causing the lid to move from a closed position, wherein the lid covers the opening, to an open position, wherein the waste container is positioned to accept waste, and then back to said closed position in response to said control signal.

2. The lid opening and closing system of claim 1, wherein said proximity sensor includes at least one sensing plate oriented horizontally.

3. The lid opening and closing system of claim 1, wherein the waste container comprises:

an open-topped receptacle; and a top cover for covering said open top, and wherein the opening is a substantially horizontal opening in said top cover.

4. The lid opening and closing system of claim 1, wherein the waste container comprises:

an open-topped receptacle defining an interior space; and a top cover for covering said open top, and wherein said drive system is located outside of said interior space.

5. The lid opening and closing system of claim 1, wherein said drive system comprises:

a motor having an output shaft; and a drive reduction system connected between said output shaft and the lid, wherein rotation of said output shaft in one direction causes the lid to move from said closed position toward said open position, and rotation of said output shaft in an opposite direction causes the lid to move from said open position back toward said closed position.

6. The lid opening and closing system of claim 5, wherein said drive reduction system comprises;

a plurality of wheels, at least one of said wheels being fixed to said output shaft;

at least one drive belt connecting said wheels;

at least one drive gear fixed to one of said wheels; and a driven gear connected to the lid, said driven gear rotatably engaged with said at least one drive gear.

7. The lid opening and closing system of claim 6, wherein said at least one drive belt is made from a flexible material.

8. The lid opening and closing system of claim 1, wherein the power to operate said sensor and said drive system is obtained from a portable power supply.

9. The lid opening and closing system of claim 8, wherein said portable power supply is attached to the waste container.

10. The lid opening and closing system of claim 1, wherein the sensitivity of said proximity sensor is variable.

11. The lid opening and closing system of claim 1, wherein the lid is pivotally mounted to said waste container and is caused to pivot alternatively between said closed and said open positions by said drive system.

12. The lid opening and closing system of claim 1, wherein the lid comprises top and bottom panels defining a wedge-shaped scoop, the lid being attached to the waste container such that the lid is pivotable within the opening between said open position wherein the bottom panel covers the opening and said scoop is positioned to receive waste material, and said closed position wherein the top panel covers the opening and said scoop is positioned to deposit waste material into the waste container.

* * * * *